United States Patent [19]

Apollonia

[11] Patent Number: 4,699,121

[45] Date of Patent: Oct. 13, 1987

[54] FUEL SAVING DEVICE

[76] Inventor: Thomas Apollonia, 515 Elwood Rd., East Northport, N.Y. 11731

[21] Appl. No.: 838,801

[22] Filed: Mar. 12, 1986

[51] Int. Cl.[4] ..... F23L 3/00

[52] U.S. Cl. ..... 126/292; 126/285 R; 126/312

[58] Field of Search ..... 126/290, 291, 292, 285 R, 126/307 R, 312; 236/45, 49

[56] References Cited

U.S. PATENT DOCUMENTS 493,580 3/1893 Flechtner ..... 126/292

1,641,875 9/1927 Beaulieu ..... 126/292

4,329,967 5/1982 Levenberg ..... 126/293

*Primary Examiner*—James C. Yeung

*Attorney, Agent, or Firm*—Richard L. Miller

[57] ABSTRACT

The invention provides a fuel saving device comprising a flue damper of simple mechanical construction mounted on a support member. A hinge connects the flue damper to the support member allowing the closure of the flue damper which is counter balanced when the furnace is shut down. When the furnace is on the gas flow opens the damper.

4 Claims, 3 Drawing Figures

FUEL SAVING DEVICE

BACKGROUND OF THE INVENTION

This invention relates to dampers for use with a furnace and more particularly to a fuel saving damper which operates in association with the operation of a furnace and flow of gases therefrom.

Flue dampers are used as shown in U.S. Pat. No. 4,108,369 granted Aug. 22, 1978 Re. 31,112 granted Dec. 28, 1982 to John Prikkel, III. This damper requires complicated electrical circuitry and complex mechanical mechanisms for operation. Additionally other flue damper devices are of complex design and expensive to produce. Furthermore, complex mechanisms deter system reliability and create an increased probability for breakdown and excessive maintenance. U.S. Pat. No. 4,372,485 granted Dec. 1, 1980 to Frances J. McCabe is another example of a complex flue damper systems, as is U.S. Pat. No. 4,477,248 granted Aug. 4, 1983 to Robert R. Dulac. These systems and others are costly to make, install and maintain.

Therefore a need exists for a simple mechanical fuel saving device which is low cost to manufacture, install and maintain.

SUMMARY OF THE INVENTION

It is a principle object of this invention to provide a new and improved damper.

It is another object of this invention to provide a new and improved fuel saving device.

It is yet another object of this invention to provide a new and improved simple mechanical fuel saving device.

It is still another object of this invention to provide a new and improved mechanical fuel saving device activated by furnace gases.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
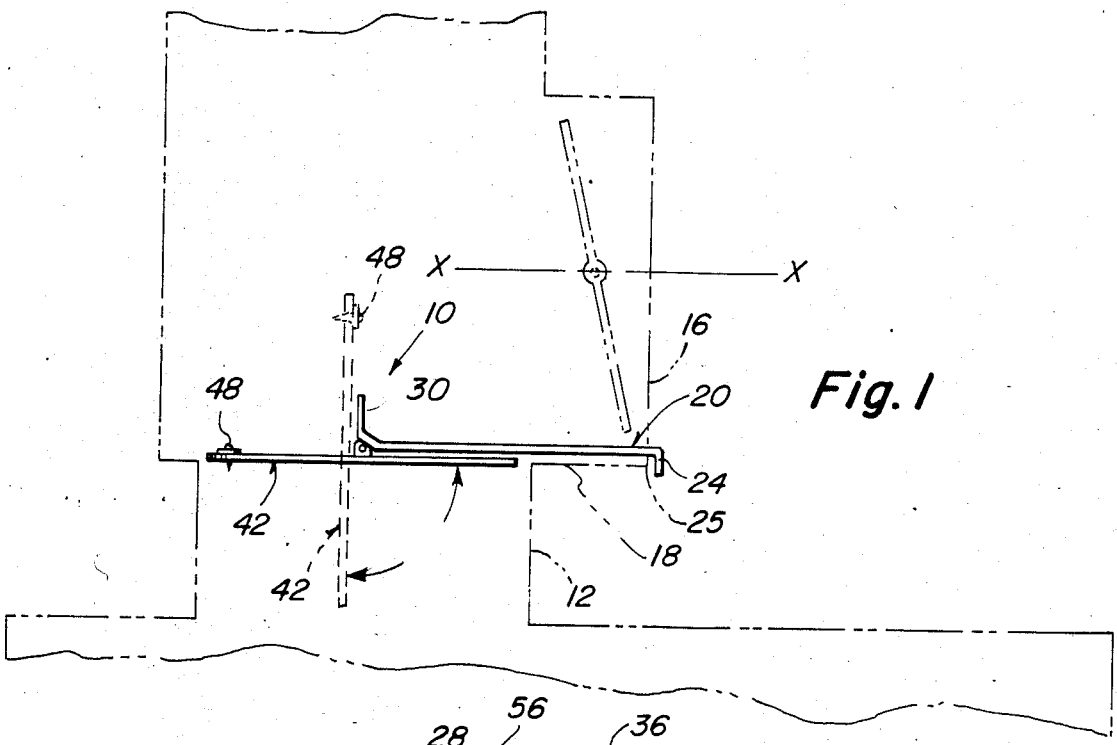
FIG. 1 is a side edge elevational view of the invention shown installed in a flue pipe of an oil burner.
Figure 2:
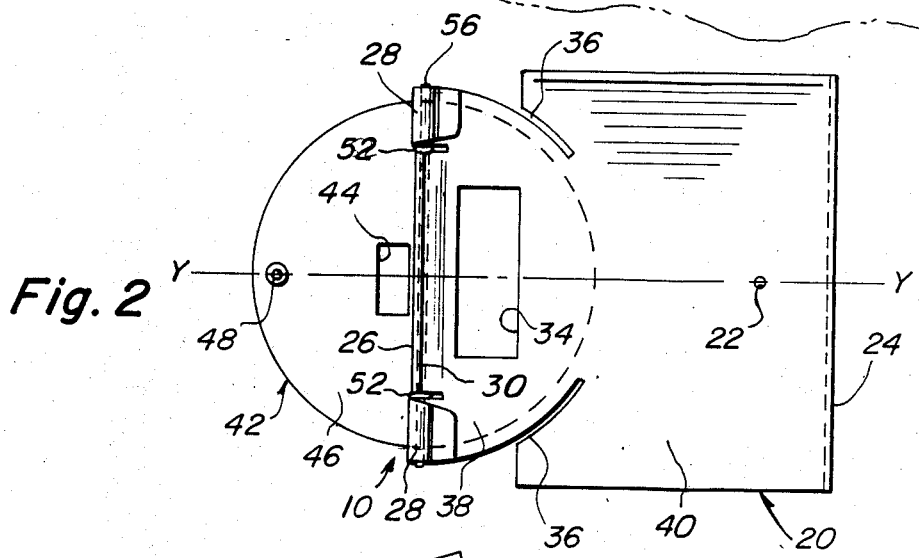
FIG. 2 is an enlarged plan view of the invention per se.

With reference to FIGS. 1 and 2 there is generally shown a fuel saving device 10. Fuel saving device 10 is positioned at the top end of a plenum 12 leading directly to a furnace.

Fuel saving device 10 is disposed in a plane perpendicular to plenum 12 mounted to an auxiliary plenum 16. Attachment of fuel saving device 10 in auxiliary plenum 16 is such that device 10 is disposed at a bottom portion 14 of auxiliary plenum 16 and device 10 being disposed in a plane parallel to line of symmetry X—X of auxiliary plenum 16 (FIG. 1). A support member 20 of device 10 is secured to bottom portion 18 which has a hole 22 essentially centrally located along line of symmetry Y—Y (FIG. 2) and at a predetermined distance from a lip 24 of support member 20. Lip 24 is disposed at one end of support member 20 in a plane perpendicular to auxiliary plenum 16 and extending over the edge of bottom portion 18 of plenum 16 and coacting with an edge 25 of bottom portion 18 of plenum 16. Attachment of support member 20 and bottom portion 18 is achieved in a conventional manner by disposition of a sheet metal screw, pop rivet, nut and bolt or the like through hole 22. Disposed at a second end 26 of support member 20 is a pair of rod support 28 and a damper stop 30 formed as an integral part of support plate 20. Rod supports 28 are formed back from edge 26 essentially 180° in a conventional manner over a die, not shown, to form a pair of rod support holes 32 with an axis Z—Z essentially perpendicular to line of symmetry Y—Y of support member 20, damper stop 30 being disposed in a plane essentially parallel to lip 24.

Figure 3:
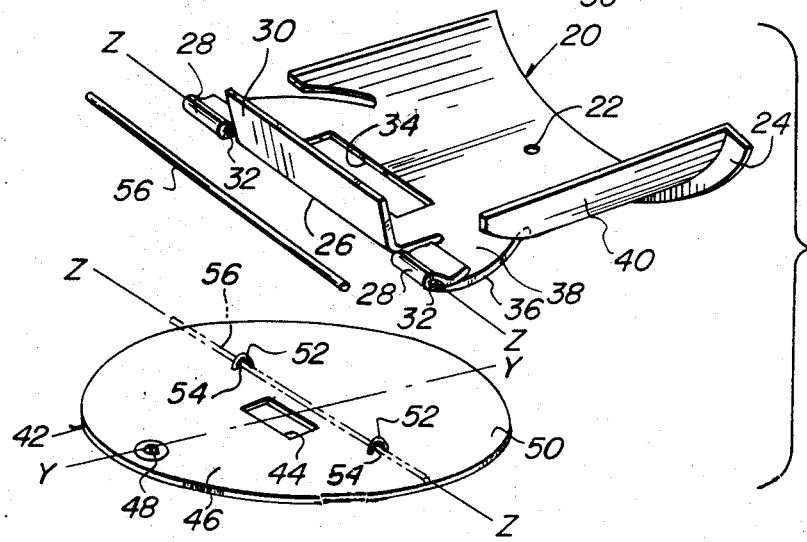
FIG. 3 is a perspective view of the invention's components shown disassembled from each other.

A rectangular opening 34 of a predetermined size is disposed proximate to edge 26 and essentially central to axis Y—Y. A pair of slots 36 are radially cut into support plate 20 (FIG. 3) at a size equal to approximately half the length of edge 26 the radial distance being taken from the center of side 26. A first portion 38 of support member 20 (FIGS. 2 and 3) is thus formed as a flat truncated half circle. A second portion 40 of support member 20 is formed cylindrically as is lip 24. A damper plate 42 as shown in FIGS. 1, 2 and 3 is a flat circular plate of essentially the same radial dimensions of first portion 38 of support 20, with a breather hole 44 proximate to line of symmetry Z—Z and disposed on a first portion 46 of damper 42, which has a counter balance 48 comprised of a sheet metal screw and washer nut and bolt or the like. The aforementioned counter balance proximate the radial periphery along axis Y—Y. A second portion 50 of damper 42 is a half circle. Damper 42 has a set of hinges 52 located along axis Z—Z and equidistant from the center of damper 42. A set of hinge openings 54 essentially the same diametral size as rod support holes 32 are formed by hinges 52. A rod 56 essentially is the same length as the diameter of damper plate 42 and has a diameter less than the size of rod support holes 32 and hinge opening 54. Assembly of damper plate 42 and support member 20 is executed by passing rod 56 through rod support holes 32 and hinge openings 54 after which rod supports 28 are crimped at their furthest radial point.

In actual operation when the furnace ignites the build up of hot gases immediately force the damper plate 42 to rotate to a vertical position there by allowing the hot gases to pass relative unimpeded. But it is when the furnace extinguishes that the device really saves fuel. This is because the pressure of the exiting gases drop rapidly and thus the device quickly rotates to a horizontal position shutting off the flow of hot exiting gases and trapping the remaining hot gases in the furnace which would other wise escape and then require additional fuel to reheat the furnace which would be partially cooled by the entering of cold ambient air.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fuel saving device fitting onto an open duct which extends from a furnace and includes a plenum at the top of the duct, the plenum having an arcuate outer edge, said device comprising:

(a) a support means having an arcuate tray portion for fitting onto the plenum, an arcuate depending lip at an outer edge of the tray portion for overlying the edge of the plenum, a flat plate extending from said arcuate tray portion for being centilevered over part of the open duct from the furnace, an inner edge on the flat plate;

(b) a damper pivotally mounted at the inner edge of the flat plate and co-acting with gases produced by the combustion of fuel in the furnace, said damper pivotally closing the duct from the furnace when combustion is stopped;

(c) an up turned ledge at the inner edge of the flat plate for limiting the pivotal rotation of the damper in its open position;

(d) a breather hole in said damper permitting limited flow out of the duct, said damper in its closed position.

2. The fuel saving device of claim 1, wherein said damper is a flat circular shape, having a diameter, and said flat plate is of corresponding semi-circular shape, and wherein an assembly of said damper to said support means comprises;

(a) a rod of predetermined length essentially equal to the diameter of said damper;

(b) a set of rod support means disposed adjacent the inner edge of said flat plate of said support means slightly forward of said up turned ledge and formed as an integral part of said flat plate; and (c) a set of hinges disposed at a predetermined distance, equidistant from a center of said damper, wherein said rod co-acts with said rod support means and said hinges, when said rod is passed through said rod support means and said hinges, said rod support means being crimped at its outer edge to secure said rod.

3. The fuel saving device of claim 1, and comprising an opening in said flat plate to allow additional gas flow.

4. The fuel saving device of claim 2, further comprising a counter-balance located proximate an edge of said damper along a center line perpendicular to the rod, and said breather hole adjacent said rod and located long said center line.

* * * * *